US010145144B1

(12) United States Patent
Shyu et al.

(10) Patent No.: US 10,145,144 B1
(45) Date of Patent: Dec. 4, 2018

(54) ELECTRIC DOOR LOCK

(71) Applicant: TUNG LUNG HARDWARE MANUFACTURING CO., LTD., Chia-Yi (TW)

(72) Inventors: Song-Gen Shyu, Min-Hsiung Hsiang (TW); Po-Yang Chen, Chiayi (TW); Chia-Chen Chang, Taipei (TW); Ming-Sheng Lin, Chia-Yi (TW)

(73) Assignee: TUNG LUNG HARDWARE MANUFACTURING CO., LTD., Chia-Yi (TW)

( * ) Notice: Subject to any disclaimer, the term of this patent is extended or adjusted under 35 U.S.C. 154(b) by 0 days.

(21) Appl. No.: 15/792,554

(22) Filed: Oct. 24, 2017

(30) Foreign Application Priority Data

May 17, 2017 (TW) ..... 106207022 U

(51) Int. Cl.

| | |
|---|---|
| ***E05B 9/08*** | (2006.01) |
| ***E05B 47/00*** | (2006.01) |
| ***E05B 9/02*** | (2006.01) |
| ***E05B 3/00*** | (2006.01) |

(52) U.S. Cl.
CPC ..... *E05B 9/08* (2013.01); *E05B 3/00* (2013.01); *E05B 9/02* (2013.01); *E05B 47/0043* (2013.01); *E05B 2047/0058* (2013.01)

(58) Field of Classification Search
CPC ..... E05B 9/08; E05B 47/0043; E05B 3/00; E05B 9/02; E05B 2047/0058; E05B 2047/0054
USPC .. 70/277, 278.1, 278.2, 278.3, 278.7, 279.1, 70/280–283, 283.1; 292/144
See application file for complete search history.

(56) References Cited

U.S. PATENT DOCUMENTS

| | | | | |
|---|---|---|---|---|
| 5,027,629 | A * | 7/1991 | Liu | E05B 47/0692 70/107 |
| 9,822,553 | B1 * | 11/2017 | Ho | E05B 47/0012 |
| 2007/0169526 | A1 * | 7/2007 | Van Der Weide | C05F 1/007 71/6 |
| 2015/0240530 | A1 * | 8/2015 | Mani | E05B 63/04 292/336.3 |
| 2016/0145904 | A1 * | 5/2016 | Lowder | E05B 63/08 340/542 |
| 2018/0058103 | A1 * | 3/2018 | Heisler | E05B 47/0012 |
| 2018/0155960 | A1 * | 6/2018 | Lowe | E05B 49/00 |
| 2018/0171666 | A1 * | 6/2018 | Tien | E05B 55/005 |

* cited by examiner

*Primary Examiner* — Lloyd A Gall
(74) *Attorney, Agent, or Firm* — Holland & Hart LLP

(57) ABSTRACT

An electric door lock includes a lock device and an electric control device. The lock device includes a latch bolt, an inner cover seat, and a handle mechanism driving movement of the latch bolt. The inner cover seat has an inner cover having an inner receiving room, and a window that is communicated with the inner receiving room. The electric control device electrically controls the lock device, and includes a middle circuit board fixedly received in the inner receiving room, and an inner circuit board removably received in the inner receiving room, removably connected to the middle circuit board, corresponding to the window in position, and removable from the inner receiving room through the window.

9 Claims, 7 Drawing Sheets

ELECTRIC DOOR LOCK

CROSS-REFERENCE TO RELATED APPLICATION

This application claims priority of Taiwanese Patent Application No. 106207022, filed on May 17, 2017.

FIELD

The disclosure relates to a door lock, and more particularly to an electric door lock.

BACKGROUND

Conventional electric door locks have different circuit designs based on different control manners, for example, magnetic card induction, remote control, fingerprint identification, password control and iris identification. No matter what the control manner is, most of the conventional electric door locks have a structure similar to that of the US patent publication No. 2007/0169525 A1. The US patent publication No. 2007/0169525 A1 discloses a conventional electric door lock including a lock device, and an electric control device that is mounted to an inner side of the lock device. The lock device includes an inner cover seat mounted to an inner side of a door, an outer cover seat mounted to an outer side of the door, a latch bolt, and a handle mechanism mounted between the inner cover seat and the outer cover seat for driving movement of the latch bolt.

The electric control device controls the handle mechanism to drive the movement of the latch bolt, and includes an outer circuit board received inside the outer cover seat, and an inner circuit board received inside the inner cover seat, and electrically connected to the outer circuit board. The outer and inner circuit boards are embedded with different electronic members based on different control manners. For example, when the conventional electric door lock is driven by a magnetic card, the outer circuit board of the conventional electric door lock must have a magnetic card induction function, and when the conventional electric door lock is driven by a fingerprint, the outer circuit board of the conventional electric door lock must have a fingerprint identification function. As such, the inner circuit board not only has basic functions to lock or unlock the door, and integrates electronic members which have different functions according to a certain control mode.

However, the conventional electric door lock integrates all the electronic members which are disposed for locking or unlocking the door onto the inner circuit board, and the inner circuit board is fixedly received in the inner cover seat. In such manner, since the inner circuit board is equipped with a large number of the electronic members, the failure rate of the inner circuit board is high. When the inner circuit board is required to be repaired or to be updated, an inner handle of the handle mechanism has to be removed first, and the inner cover seat then has to be removed as well. A user can check or replace the inner circuit board after the inner cover seat is removed, and the inner handle and the inner cover seat are reassembled after the user checks or replaces the inner circuit board. Since the inner handle and a plurality of door lock members are connected together for driving the movement of the latch bolt, the process to disassemble or assemble the electric door lock is complicated, so that it is inconvenient for the user to repair the inner circuit board.

In addition, the conventional electric door lock requires electric energy from batteries, and the batteries are usually received inside the inner cover seat so that, when the batteries are required to be replaced, the inner handle is also required to be removed and the inner cover seat is also required to be disassembled. Therefore, it is also inconvenient for the user to replace the batteries.

SUMMARY

Therefore, the object of the disclosure is to provide an electric door lock that can alleviate at least one of the drawbacks of the prior art.

According to the disclosure, the electric door lock is adapted to be mounted to a door, and is adapted to lock or unlock the door in an electric control manner. The electric door lock includes a lock device and an electric control device. The lock device includes a latch bolt, an inner cover seat adapted to be mounted to an inner side of the door, and a handle mechanism adapted to be mounted to the door, driving movement of the latch bolt, and including an inner handle. The inner cover seat has an inner cover adapted to be mounted to the door, and having an inner receiving room, and a window that is communicated with the inner receiving room. The inner handle of the handle mechanism extends through the inner cover of the inner cover seat. The electric control device electrically controls the lock device, and includes a middle circuit board fixedly received in the inner receiving room, and an inner circuit board removably received in the inner receiving room, removably connected to the middle circuit board, corresponding to the window in position, and removable from the inner receiving room through the window.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
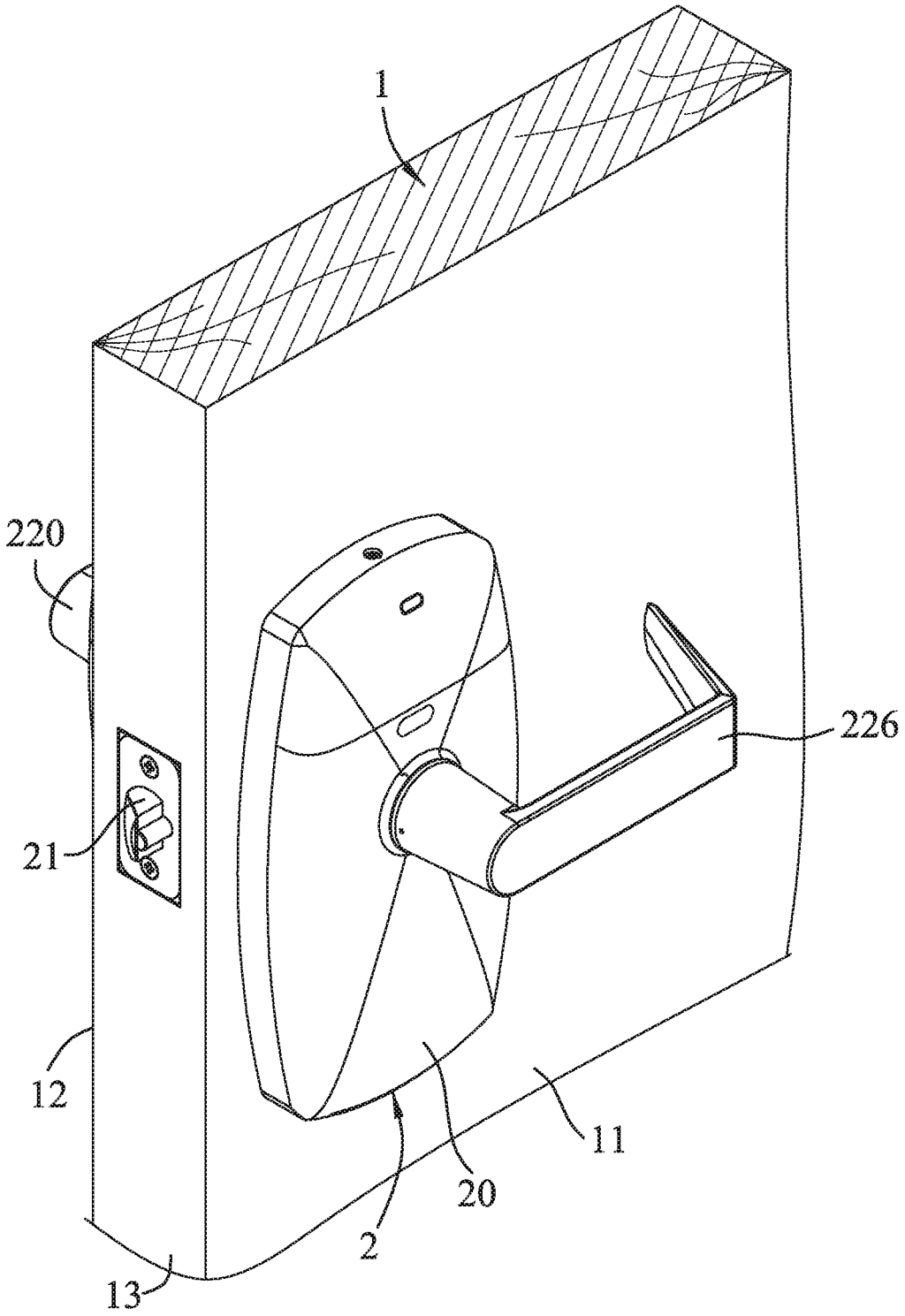
FIG. 1 is a fragmentary perspective view of an embodiment of an electric door lock according to the disclosure.
Figure 2:
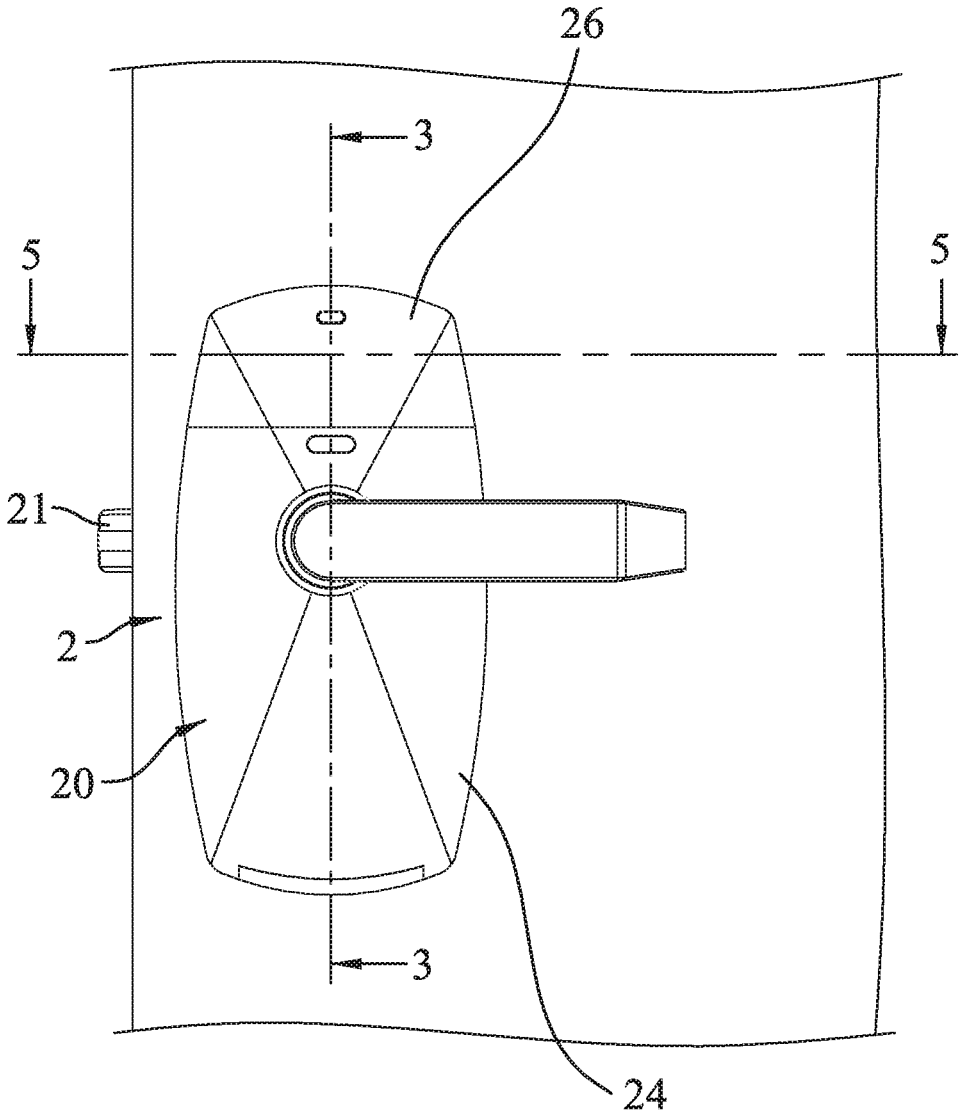
FIG. 2 is a side view of the embodiment.
Figure 3:
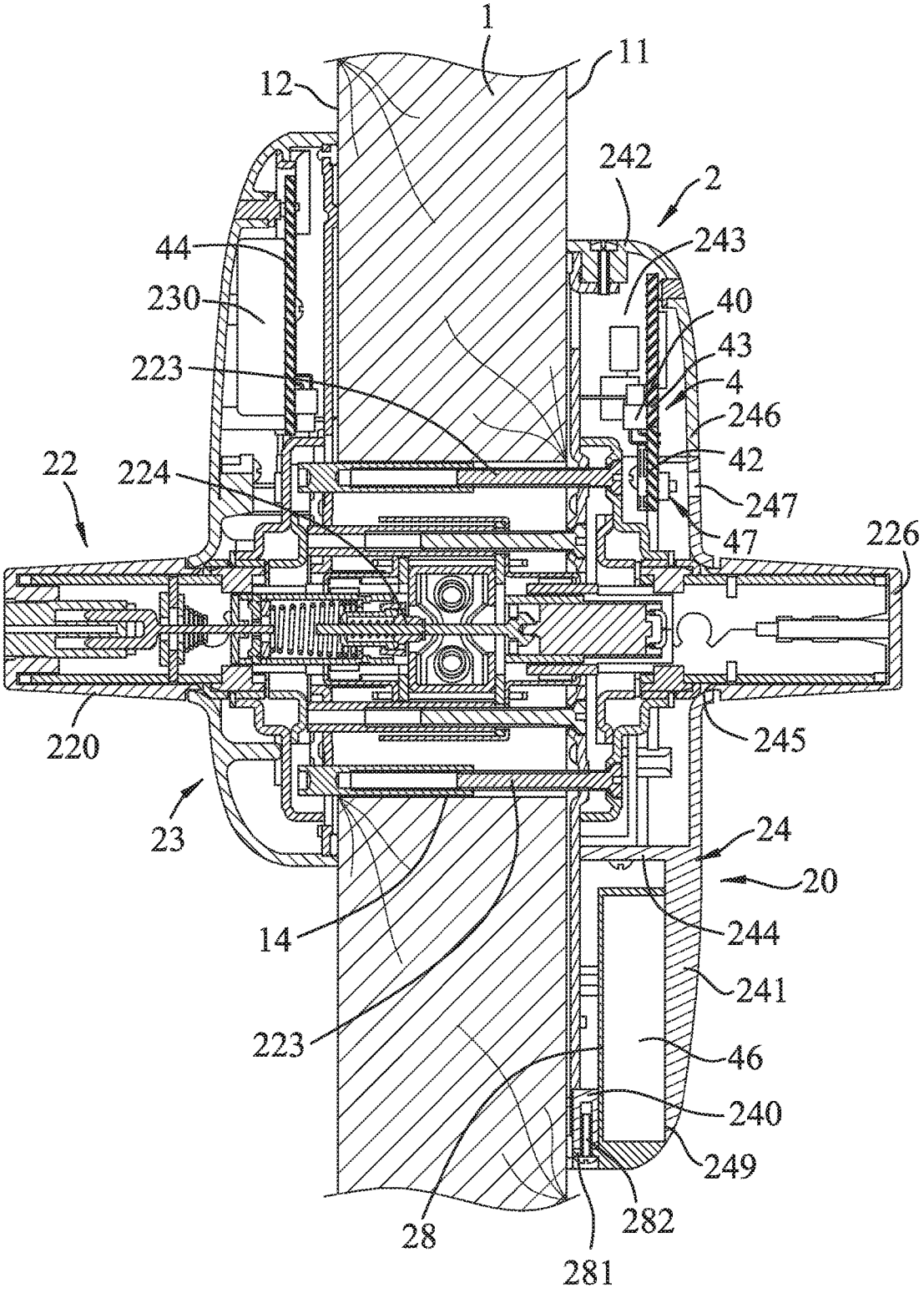
FIG. 3 is a sectional view taken along line 3-3 in FIG. 2.

Referring to FIGS. 1 to 3, the embodiment of an electric door lock according to the disclosure is adapted to be mounted to a door 1, and is adapted to lock or unlock the door 1 in an electric control manner. The door 1 has an inner surface 11, an outer surface 12 spaced apart from the inner surface 11, a side surface 13 vertically connected between the inner and outer surfaces 11, 12, and a mounting hole 14 extending through the inner and outer surfaces 11, 12. The electric door lock includes a lock device 2 adapted to be mounted to the door 1, and an electric control device 4 received in the lock device 2, and electrically controlling the lock device 2.

The lock device 2 includes a latch bolt 21 movable through the side surface 13 of the door 1, an inner cover seat 20 adapted to be mounted to the inner surface 11 of the door 1, an outer cover seat 23 adapted to be mounted to the outer surface 12 of the door 1, and a handle mechanism 22 adapted to be mounted to the door 1. The handle mechanism 22 drives movement of the latch bolt 21 relative to the side surface 13 of the door 1, and since the structures of the latch bolt 21 and the handle mechanism 22, and the connecting relationship between the latch bolt 21 and the handle mechanism 22 are well-known in the art, only the details of related parts will be mentioned in the following description.

Figure 4:
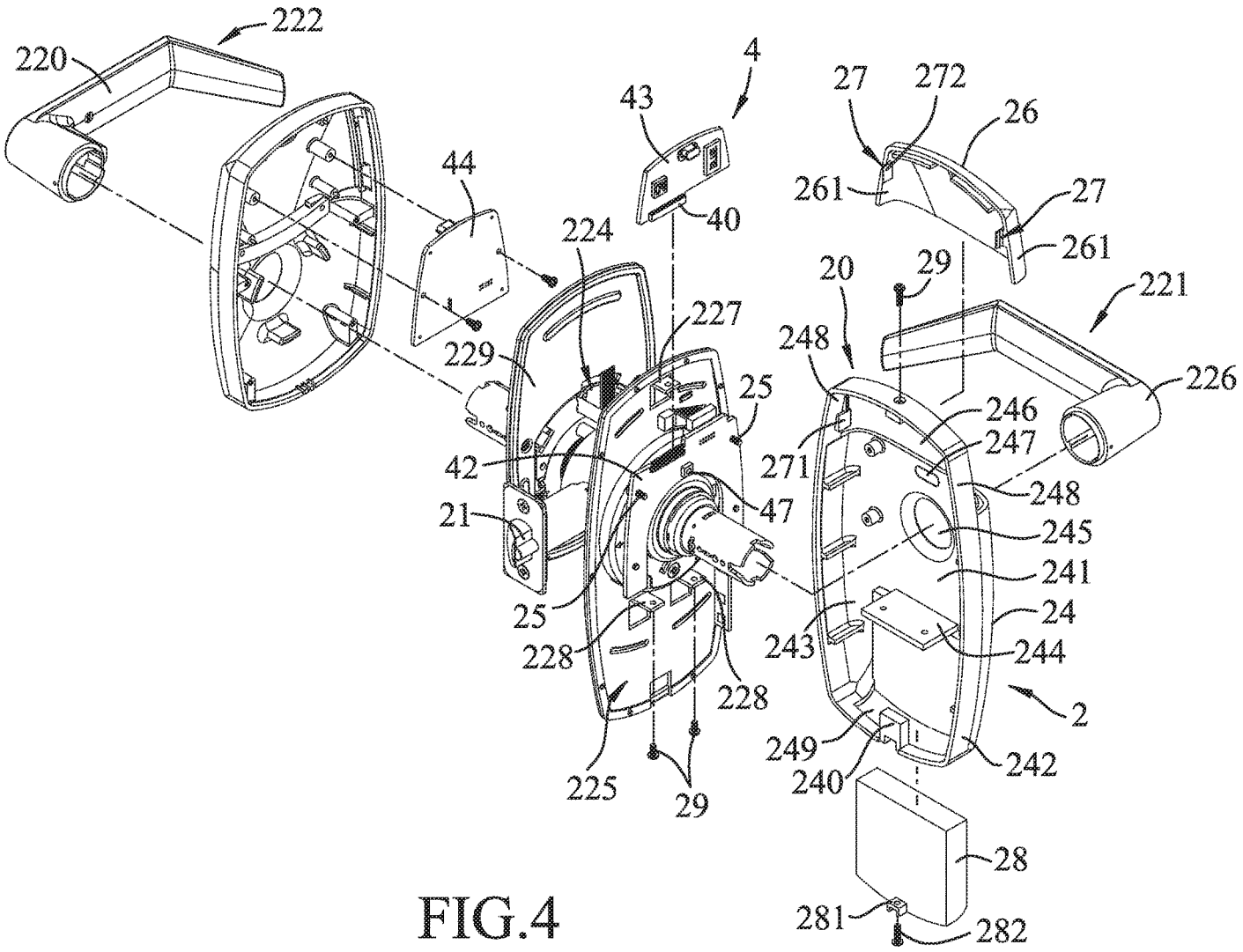
FIG. 4 is a partly exploded perspective view of the embodiment.
Figure 5:
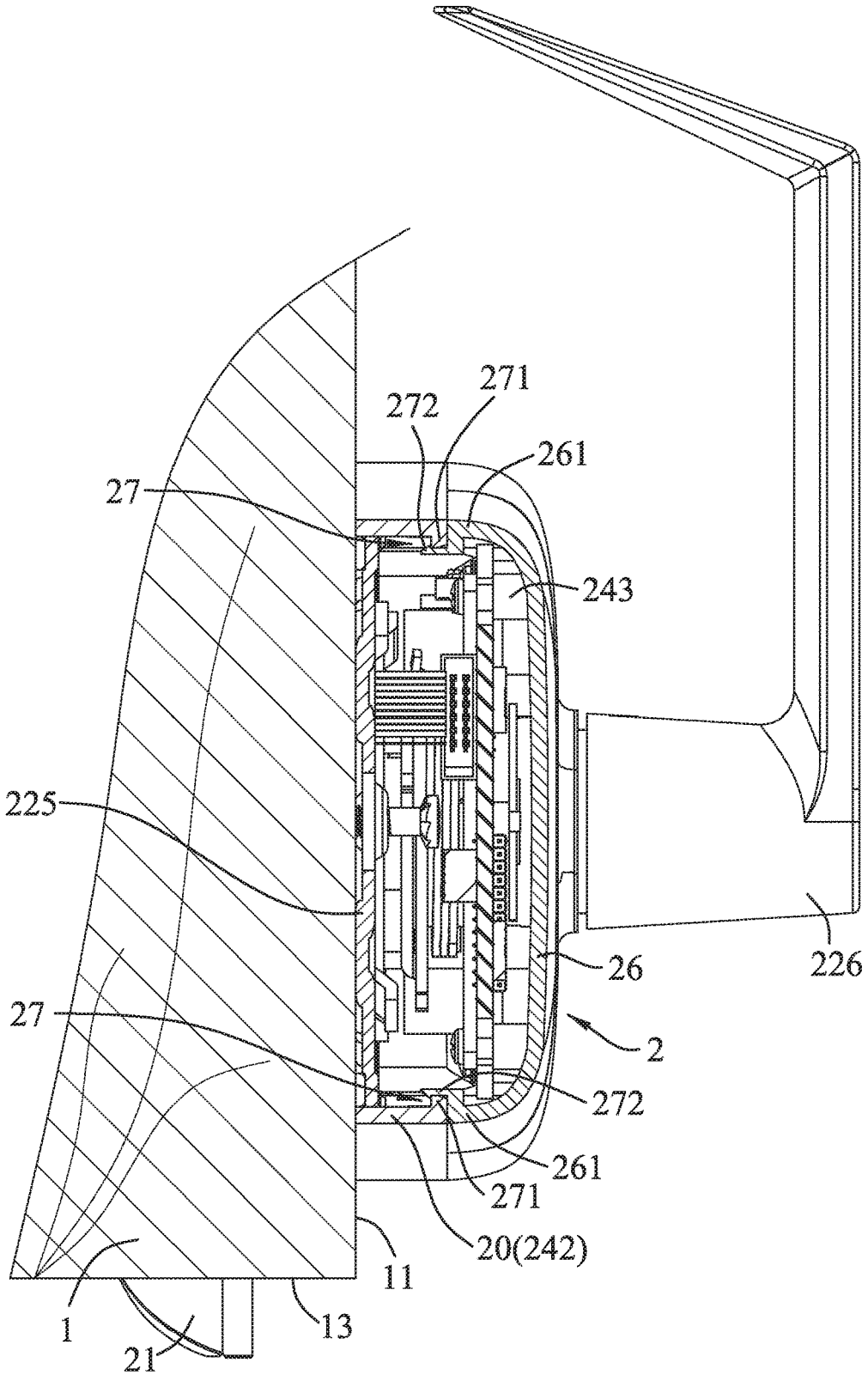
FIG. 5 is a fragmentary sectional view taken along line 5-5 in FIG. 2.

Referring to FIGS. 3 to 5, the handle mechanism 22 includes an inner handle unit 221 adapted to be disposed at an inner side of the door 1, an outer handle unit 222 adapted to be disposed at an outer side of the door 1, a plurality of coupling members 223 coupling the inner handle unit 221 and the outer handle unit 222 together, and a driving unit 224 adapted to be mounted in the mounting hole 14 of the door 1, and controlling the movement of the latch bolt 21.

The inner handle unit 221 includes an inner fixed seat 225 adapted to be mounted to the inner surface 11 of the door 1, and an inner handle 226 rotatably mounted to the inner fixed seat 225. The inner fixed seat 225 has a first connecting plate 227 protruding inwardly, and two second connecting plates 228 disposed below the first connecting plate 227, and protruding inwardly. The outer handle unit 222 has an outer fixed seat 229 and an outer handle 220. The coupling members 223 are adapted to fix the inner fixed seat 225 and the outer fixed seat 229 to the door 1.

The inner cover seat 20 has an inner cover 24, a cover body 26, at least one snap fit mechanism 27 interconnecting the cover body 26 and the inner cover 24, and a battery box 28 removably mounted to the inner cover 24. It should be noted that, in this embodiment, the inner cover seat 20 has two snap fit mechanisms 27, and the number of the snap fit mechanism 27 may be varied in other embodiments.

The inner cover 24 is adapted to be mounted to the door 1, and has a cover wall 241, a surrounding wall 242 extending from the cover wall 241 toward the inner surface 11 of the door 1, an inner receiving room 243, and an abutment wall 244 protruding from the cover wall 241 and overlapping the second connecting plates 228 of the handle mechanism 22. The cover wall 241 cooperates with the surrounding wall 242 to define the inner receiving room 243. The cover wall 241 has a handle mounting hole 245, a window 246 communicated with the inner receiving room 243, and a button hole 247 formed therethrough and formed between the handle mounting hole 245 and the window 246. The cover wall 241 has a top end defining a bottom end of the window 246. The inner handle 226 of the handle mechanism 22 extends through the handle mounting hole 245 of the inner cover 24. The surrounding wall 242 has two opposite first jointing sections 248 respectively disposed at two opposite sides of the window 246, a battery opening 249 communicated with a bottom end of the inner receiving room 243, and a first connecting block 240 disposed proximate to the battery opening 249. The inner cover seat 20 further has a plurality of fixing screws 29 disposed for fixing the inner cover 24 to the inner fixed seat 225. One part of the fixing screws 29 fix the surrounding wall 242 to the first connecting plate 227, and the remaining part of the fixing screws 29 fix the abutment wall 244 to the second connecting plates 228.

The cover body 26 removably covers the window 246 of the inner cover 24, and has two opposite second jointing sections 261 respectively jointed to the first jointing sections 248. Each of the snap fit mechanisms 27 has a first hook 271, and a second hook 272 hooked with the first hook 271. The first hooks 271 of the snap fit mechanisms 27 are respectively disposed at the first jointing sections 248 of the inner cover 24, and the second hooks 272 of the snap fit mechanisms 27 are respectively disposed at the second jointing sections 261 of the cap body 26. It should be noted that, the configuration of the snap fit mechanism 27 may be varied in other embodiments, for example, a hook may be disposed to engage a groove.

The battery box 28 is received in the inner receiving room 243 of the inner cover 24, is removable from the inner receiving room 243 through the battery opening 249, and has a second connecting block 281 corresponding to the first connecting block 240 in position, and a coupling screw 282 fixing the second connecting block 281 to the first connecting block 240. The outer cover seat 23 has an outer receiving room 230.

Figure 6:
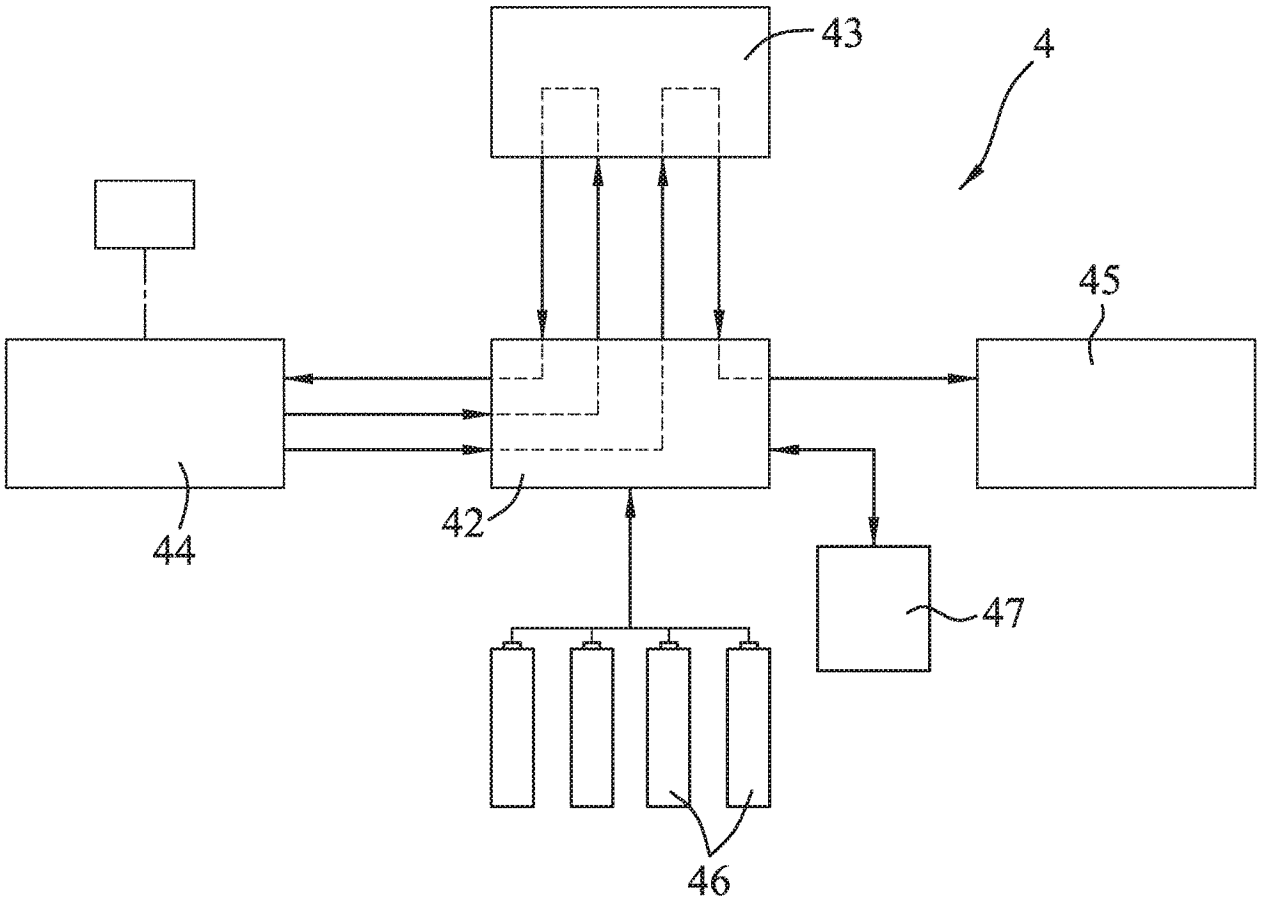
FIG. 6 is a working diagram of an electric control device of the embodiment.

Referring to FIGS. 3, 4 and 6, the electric control device 4 electrically controls the lock device 2 to allow the handle mechanism 22 to drive the movement of the latch bolt 21. It should be noted that, the control manner of the electric control device 4 may be varied in different embodiments, for example, image recognition, magnetic card induction, remote control, password control and biological feature identification. The magnetic card induction may include RF reception and wireless transmission. The remote control may be Bluetooth transmission. The biological feature identification may include fingerprint identification and iris identification.

The electric control device 4 includes a middle circuit board 42 fixedly received in the inner receiving room 243, and disposed at an outer side of the cover wall 241 of the cover body 24, an inner circuit board 43 removably received in the inner receiving room 243, removably connected to the middle circuit board 42, corresponding to the window 246 in position, and removable from the inner receiving room 243 through the window 246, at least one power connecting member 40 fixedly mounted to the outer circuit board 43, and electrically connecting the outer circuit board 43 to the middle circuit board 42, an outer circuit board 44 received in the outer receiving room 230, and electrically connected to the middle circuit board 42, a power source 45 electrically connected to the middle circuit board 42, a plurality of power supplies 46 received in the battery box 28, electrically connected to the middle circuit board 42, and providing electric energy for the power source 45, and a button 47 mounted to and electrically connected to the middle circuit board 42, and corresponding to the button hole 247 in position. The button 47 is disposed for circuit test and circuit reset. It should be noted that, in this embodiment, the power connecting member 40 is configured as a socket so as to connect the inner circuit board 43 to the middle circuit board 42, and the configuration of the power connecting member 40 may be varied in other embodiments. The middle circuit board 42 drives the power source 45 to allow the handle mechanism 22 to drive the movement of the latch bolt 21. Since the details of electric control for driving the movement of the latch bolt 21 are well-known in the art, are thus omitted herein for the sake of brevity. The inner cover seat 20 further has a plurality of connecting screws 25 fixing the middle circuit board 42 to the inner fixed seat 225.

The middle circuit board 42, the inner circuit board 43 and the outer circuit board 44 can be provided with different electronic members and circuits based on the requirements. In this embodiment, the disposition of the outer circuit board 44 is based on the control manner requirements, for example, when the electric door lock is driven by a magnetic card, the outer circuit board 44 is provided with the electronic members that can be induced by the magnetic card, and when the electric door lock is driven by a biological feature, the outer circuit board 44 is provided with the electronic members that can identify the biological feature. The middle circuit board 42 is preferably provided with the electronic members that is stable and that is not easy to breakdown. In this embodiment, the middle circuit board 42 is provided with a driving circuit that is connected to the power source 45 and the power supplies 46, and a connecting circuit that is connected between the inner circuit board 43 and the outer circuit board 44. The inner circuit board 43 is suitable for being provided with the electronic members that may be easy to breakdown, that may be required to be updated, or that may be required to be frequently replaced. It should be noted that, in this embodiment, the power supplies 46 are configured as batteries, and the configuration of the power supplies 46 may be varied in other embodiments such as an indoor power source supply.

It should be noted that, since the control manner of the electric door lock is variable, magnetic card induction will be the only one example in the following description. During an unlock operation, when a user put the magnetic card close to the outer circuit board 44, the induced signal is firstly transmitted to the inner circuit board 43 through the middle circuit board 42, and the induced signal is then transmitted back to the outer circuit board 44 through the middle circuit board 42 to drive the outer circuit board 44 to read the data of the magnetic card. The read data is then transmitted to the inner circuit board 43 through the middle circuit board 42 to be analyzed. When the read data is correct, the middle circuit board 42 subsequently controls the power source 45 to output a mechanical power to unlock the door 1, the user can then operate the handle mechanism 22 to drive the movement of the latch bolt 21. When the read data is not correct, the power source 45 will not be driven. It should be noted that, when the control manner is Bluetooth transmission, the inner circuit board 43 will directly drive the middle circuit board 42 to control the power source 45 after receiving the induced signal.

Figure 7:
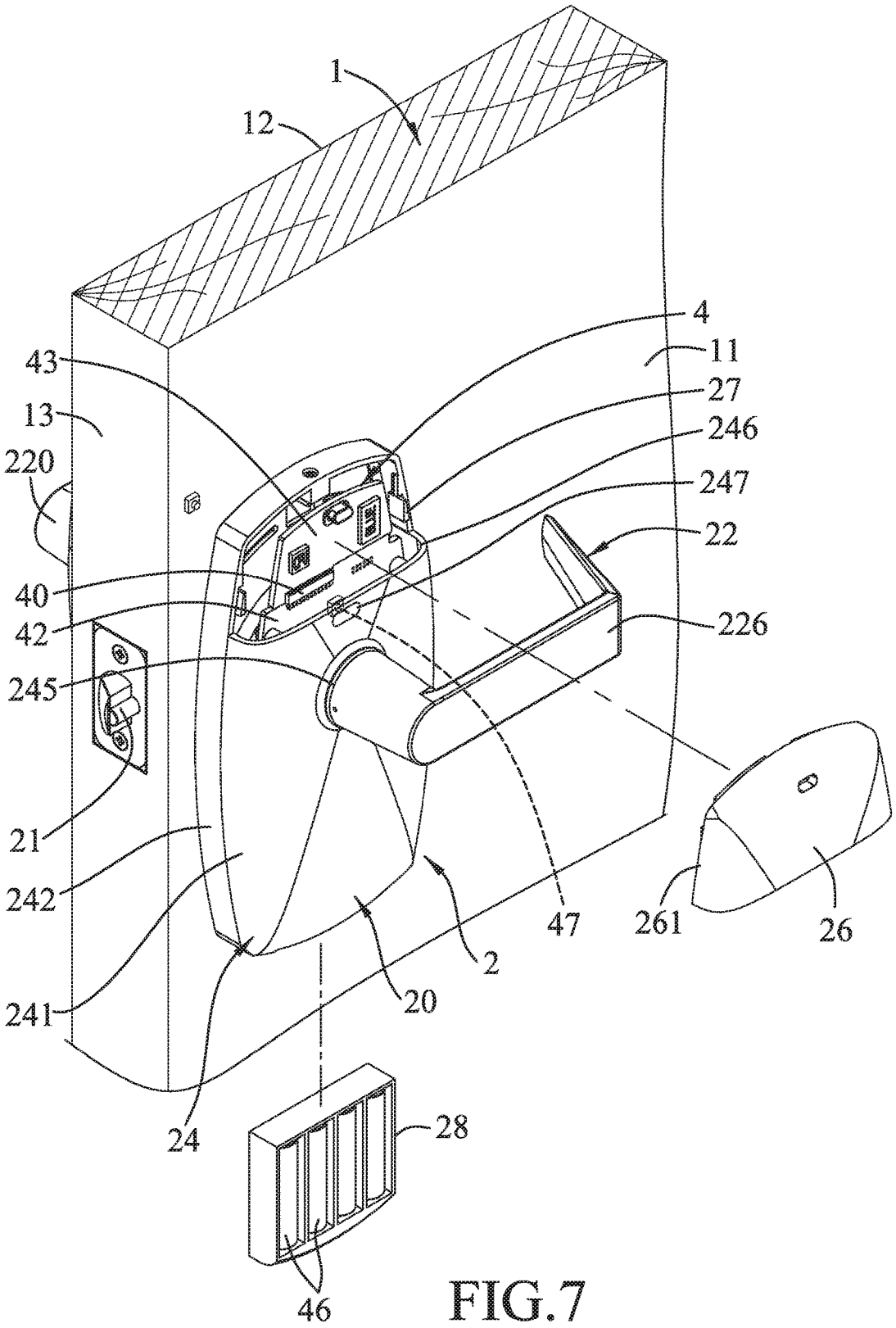
FIG. 7 is a fragmentary and partly exploded perspective view of the embodiment when the electric door lock is in a repairing operation.

Referring to FIGS. 4, 5 and 7, when the inner circuit board 43 is broken, the user only needs to press the second jointing sections 261 of the cover body 26 toward each other with the two fingers, and the second hooks 272 are then deformed to be separated from the first hooks 271. Subsequently, the cover body 26 is removed from the inner cover 24, and the broken inner circuit board 43 is then repaired or replaced through the window 246. In addition, when the inner circuit board 43 is required to be updated, the user only needs to follow the above-mentioned procedure to remove the inner circuit board 43 through the window 246. After a repairing, replacing or updating operation is finished, the user has to press the button 47 to test and reset the electric door lock. Since the inner handle 226 and the inner cover 24 are not required to be removed from the electric door lock during the repairing, replacing or updating operation, such operation is quite convenient for the user.

Moreover, when the power supplies 46 run out of power, the user only requires to remove the coupling screw 282 to remove the battery box 28 from the inner cover 24, so that the inner handle 226 is also not required to be removed during a battery replacement operation, and such operation is also convenient for the user. Furthermore, since the fixing screws 29 fix the inner cover 24 to the handle mechanism 22, it is convenient to remove the inner cover 24 from the handle mechanism 22.

In conclusion, with the configurations of the electric door lock, the convenience of an electric door lock repairing operation is greatly increased.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electric door lock is adapted to be mounted to a door, and is adapted to lock or unlock the door in an electric control manner, comprising:

a lock device including a latch bolt, an inner cover seat that is adapted to be mounted to an inner side of the door, and a handle mechanism that is adapted to be mounted to the door, that drives movement of said latch bolt, and that includes an inner handle, said inner cover seat having an inner cover that is adapted to be mounted to the door, and that has an inner receiving room, and a window communicated with said inner receiving room, said inner handle of said handle mechanism extending through said inner cover of said inner cover seat; and an electric control device electrically controlling said lock device, and including a middle circuit board that is fixedly received in said inner receiving room, and an inner circuit board that is removably received in said inner receiving room, that is removably connected to said middle circuit board, that corresponds to said window in position, and that is removable from said inner receiving room through said window.

2. The electric door lock as claimed in claim 1, wherein said inner cover seat further has a cover body, and at least one snap fit mechanism interconnecting said cover body and said inner cover so as to allow said cover body to removably cover said window of said inner cover.

3. The electric door lock as claimed in claim 2, wherein:

said inner cover further has a cover wall, and a surrounding wall connected to said cover wall, and cooperating with said cover wall to define said inner receiving room;

said surrounding wall has two opposite first jointing a sections, said cover body having two opposite second jointing sections that are respectively jointed to said first jointing sections; and said inner cover seat further has two snap fit mechanisms, each of which has a first hook, and a second hook hooked with said first hook, said first hooks of said snap fit mechanisms being respectively disposed at said first jointing sections of said inner cover, said second hooks of said snap fit mechanisms being respectively disposed at said second jointing sections of said cover body.

4. The electric door lock as claimed in claim 2, wherein:

said inner cover further has a cover wall, and a surrounding wall connected to said cover wall, and cooperating with said cover wall to define said inner receiving room;

said surrounding wall has a battery opening communicated with said inner receiving room; and said inner cover seat further has a battery box received in said inner receiving room of said inner cover, and removable from said inner receiving room through said battery opening.

5. The electric door lock as claimed in claim 4, wherein said surrounding wall of said inner cover further has a first connecting block disposed proximate to said battery opening, said battery box having a second connecting block that corresponds to said first connecting block in position, and a coupling screw that fixes said second connecting block to said first connecting block.

6. The electric door lock as claimed in claim 2, wherein said inner cover further has a cover wall disposed at an inner side of said middle circuit board, and having a button hole that is formed therethrough, said electric control device further including a button that is mounted to and electrically connected to said middle circuit board, and that corresponds to said button hole in position.

7. The electric door lock as claimed in claim 2, wherein:

said handle mechanism further includes an inner fixed seat adapted to be mounted to the door, and having a first connecting plate that protrudes toward said inner cover, and two second connecting plates that protrude toward said inner cover;

said inner cover further has a cover wall having a top end that defines a bottom end of said window, a surrounding wall connected to said cover wall, and cooperating with said cover wall to define said inner receiving room, and an abutment wall protruding from said cover wall and overlapping said second connecting plates of said handle mechanism; and said inner cover seat further has a plurality of fixing screws, one part of said fixing screws fixing said surrounding wall to said first connecting plate, and the remaining part of said fixing screws fixing said abutment wall to said second connecting plates.

8. The electric door lock as claimed in claim 1, wherein said electric control device further includes a power source electrically connected to said middle circuit board, and driven by said middle circuit board to allow said handle mechanism to drive the movement of said latch bolt, and a power supply electrically connected to said middle circuit board, and providing electric energy for said power source.

9. The electric door lock as claimed in claim 8, wherein said lock device further includes an outer cover seat a adapted to be mounted to an outer side of the door, and having an outer receiving room, said electric control device further including an outer circuit board that is received in said outer receiving room, and that is electrically connected to said middle circuit board.

* * * * *